US005564286A

United States Patent [19]

Suse

[11] Patent Number: 5,564,286

[45] Date of Patent: Oct. 15, 1996

[54] REFRIGERATOR DEFROST CONTROL APPARATUS AND METHOD

[75] Inventor: Yasuo Suse, Osaka-fu, Japan

[73] Assignee: Kabushiki Kaisha Toshiba, Kawasaki, Japan

[21] Appl. No.: 408,973

[22] Filed: Mar. 23, 1995

[30] Foreign Application Priority Data

Mar. 24, 1994 [JP] Japan ..... 6-053796

[51] Int. Cl.[6] ..... F25D 11/00

[52] U.S. Cl. ..... 62/153; 62/155; 62/156

[58] Field of Search ..... 62/80, 131, 151, 62/153, 154, 155, 156, 234, 157, 158

[56] References Cited

U.S. PATENT DOCUMENTS 4,297,852 11/1981 Brooks ..... 62/155 X
4,481,785 11/1984 Tershak et al. ..... 62/156 X
5,315,835 5/1994 Park ..... 62/153 X

FOREIGN PATENT DOCUMENTS 4-1900075 7/1992 Japan ..... 62/153

*Primary Examiner*—Harry B. Tanner
*Attorney, Agent, or Firm*—Cushman, Darby & Cushman

[57] ABSTRACT

A defrost control apparatus and method for controlling the defrosting of a cooling coil of a refrigerator by estimating a postpone defrost time to postpone the defrosting of the cooling coil in accordance with fuzzy logic reasoning. The fuzzy logic reasoning uses the total number of times a door on the refrigerator is opened and an outside temperature value related to the outside temperature as input variables. The fuzzy logic estimate is produced at predetermined time intervals after a compressor of the refrigerator has operated a predetermined time since the last defrosting. The defrost control apparatus counts the total refrigerator operating time period after the compressor has operated the predetermined time. The defrost control apparatus starts to defrost the cooling coil when the total refrigerator operating time period exceeds the postpone defrost time.

27 Claims, 7 Drawing Sheets

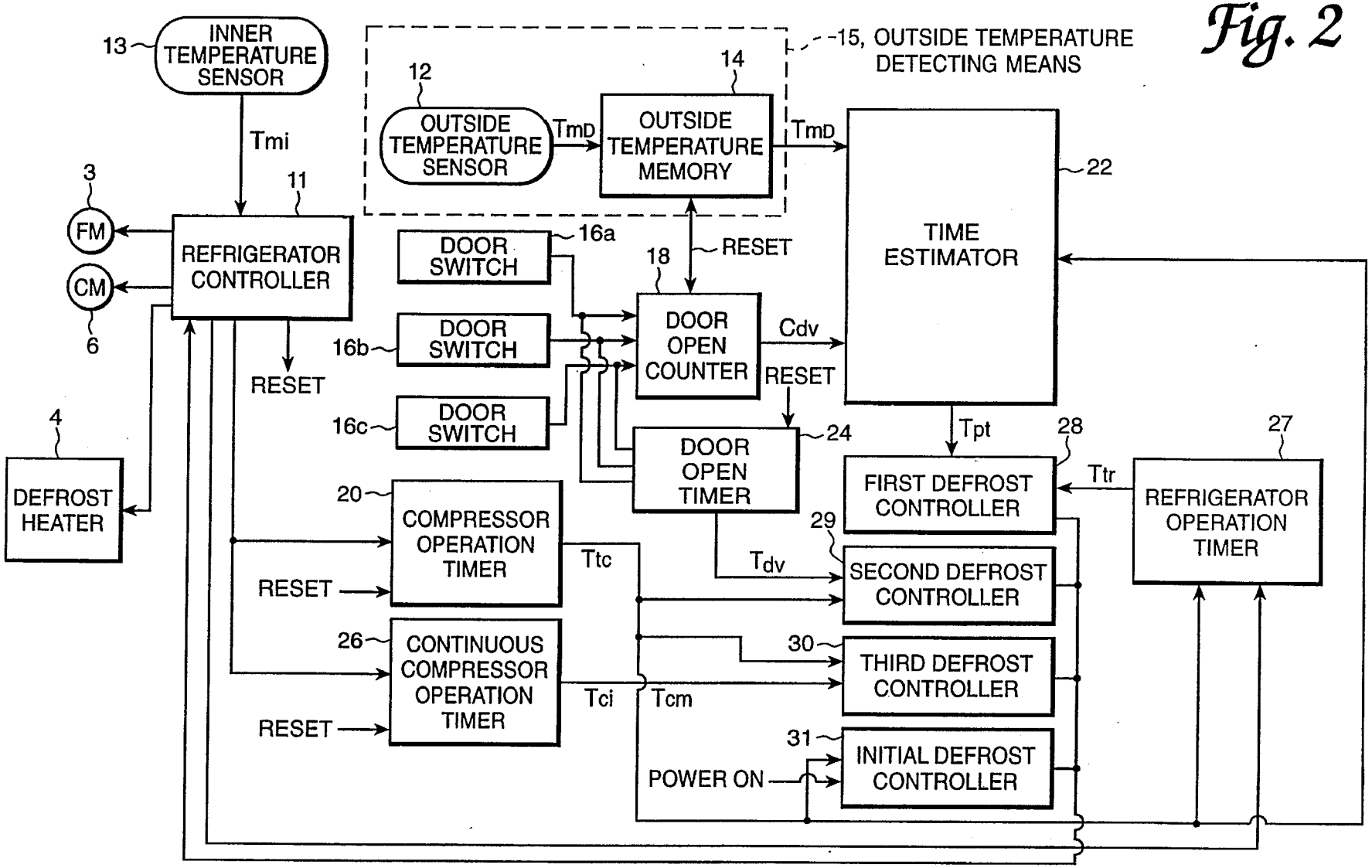
Fig. 2
15, OUTSIDE TEMPERATURE DETECTING MEANS
OUTSIDE TEMPERATURE SENSOR
12
OUTSIDE TEMPERATURE MEMORY
14
TmD
TmD
TIME ESTIMATOR
22
Tpt
Cdv
RESET
RESET
DOOR OPEN COUNTER
18
DOOR OPEN TIMER
24
Tdv
REFRIGERATOR OPERATION TIMER
27
Ttr
FIRST DEFROST CONTROLLER
28
SECOND DEFROST CONTROLLER
29
THIRD DEFROST CONTROLLER
30
INITIAL DEFROST CONTROLLER
31
POWER ON
Tcm
Tci
Ttc
DOOR SWITCH
16a
DOOR SWITCH
16b
DOOR SWITCH
16c
COMPRESSOR OPERATION TIMER
20
CONTINUOUS COMPRESSOR OPERATION TIMER
26
RESET
RESET
INNER TEMPERATURE SENSOR
13
Tmi
REFRIGERATOR CONTROLLER
11
RESET
FM
3
CM
6
DEFROST HEATER
4

Fig. 6

| A | * | B | = | C | A | * | B | = | C |
|---|---|---|---|---|---|---|---|---|---|
| 1 | * | 1 | = | 1 | 5 | * | 1 | = | 8 |
| 1 | * | 2 | = | 1 | 5 | * | 2 | = | 6 |
| 1 | * | 3 | = | 1 | 5 | * | 3 | = | 5 |
| 1 | * | 4 | = | 1 | 5 | * | 4 | = | 3 |
| 1 | * | 5 | = | 1 | 5 | * | 5 | = | 2 |
| 1 | * | 6 | = | 1 | 5 | * | 6 | = | 1 |
| 1 | * | 7 | = | 1 | 5 | * | 7 | = | 1 |
| 1 | * | 8 | = | 1 | 5 | * | 8 | = | 1 |
| 2 | * | 1 | = | 2 | 6 | * | 1 | = | 7 |
| 2 | * | 2 | = | 2 | 6 | * | 2 | = | 6 |
| 2 | * | 3 | = | 2 | 6 | * | 3 | = | 5 |
| 2 | * | 4 | = | 2 | 6 | * | 4 | = | 3 |
| 2 | * | 5 | = | 2 | 6 | * | 5 | = | 1 |
| 2 | * | 6 | = | 1 | 6 | * | 6 | = | 1 |
| 2 | * | 7 | = | 1 | 6 | * | 7 | = | 1 |
| 2 | * | 8 | = | 1 | 6 | * | 8 | = | 1 |
| 3 | * | 1 | = | 8 | 7 | * | 1 | = | 6 |
| 3 | * | 2 | = | 8 | 7 | * | 2 | = | 4 |
| 3 | * | 3 | = | 7 | 7 | * | 3 | = | 3 |
| 3 | * | 4 | = | 6 | 7 | * | 4 | = | 1 |
| 3 | * | 5 | = | 5 | 7 | * | 5 | = | 1 |
| 3 | * | 6 | = | 4 | 7 | * | 6 | = | 1 |
| 3 | * | 7 | = | 3 | 7 | * | 7 | = | 1 |
| 3 | * | 8 | = | 1 | 7 | * | 8 | = | 1 |
| 4 | * | 1 | = | 8 | 8 | * | 1 | = | 5 |
| 4 | * | 2 | = | 7 | 8 | * | 2 | = | 3 |
| 4 | * | 3 | = | 6 | 8 | * | 3 | = | 1 |
| 4 | * | 4 | = | 4 | 8 | * | 4 | = | 1 |
| 4 | * | 5 | = | 3 | 8 | * | 5 | = | 1 |
| 4 | * | 6 | = | 2 | 8 | * | 6 | = | 1 |
| 4 | * | 7 | = | 1 | 8 | * | 7 | = | 1 |
| 4 | * | 8 | = | 1 | 8 | * | 8 | = | 1 |

REFRIGERATOR DEFROST CONTROL APPARATUS AND METHOD

BACKGROUND OF THE INVENTION

1. Field of the Invention

The present invention relates to an apparatus and method for controlling refrigerator defrosting.

2. Description of the Related Art

A conventional refrigerator has a closed refrigeration circuit including a cooling coil to cool compartments in the refrigerator, an expansion device, a radiation coil and a compressor. Refrigerant in the closed circuit is compressed by the compressor, then flows to the radiation coil. The compressed gaseous refrigerant, having a high temperature, is cooled in the radiation coil, and becomes liquid. The liquid refrigerant passes through the expansion valve, reducing its pressure and temperature. The cold liquid refrigerant flows into the cooling coil. Air passing through the compartments blows on the cooling coil and circulates in the compartments as a result of a circulation fan mounted in an air circulation path in the refrigerator. Therefore, the compartments are cooled. At the same time, liquid refrigerant in the cooling coil is heated by the air and evaporates. Energization of the circulation fan and compressor are controlled in accordance with the temperature in the compartments.

In the compartments, water included in the air as vapor is condensed on the cooling coil surface. The condensed water on the cooling coil surface becomes ice. The thermal conductivity of the cooling coil is decreased as a result of the ice. Further, the accumulation of ice reduces the amount of air passing by the coil. Consequently, the cooling capacity of the refrigerator is decreased and it is difficult to cool compartments. Therefore, the conventional refrigerator has a defrost operation to defrost the ice on the cooling coil.

In the defrost operation, the cooling coil is heated by an electrical defrost heater located near the cooling coil. The timing of the defrost operation is controlled by a defrost start timer. Two kinds of defrost timers are popularly used in conventional refrigerators. A first defrost timer measures time after a previous defrost operation is finished and outputs a defrost start signal when the time counted reaches a first predetermined time. A second defrost start timer measures the time that the compressor is energized and outputs the defrost start signal when that time reaches a second predetermined time.

Both of these defrost timers are reset when the defrost operation is finished. Accordingly, the defrost operation is carried out at intervals determined by the first or second defrost timer. The first and second predetermined times are constant values, and are determined for heavy load conditions when much vapor is included in the air. Thus, in the conventional refrigerator, the predetermined times between defrosts are set shorter than what is needed in normal or light conditions. Consequently, in normal or light conditions, where little or normal vapor is included in the air, defrost operations are started before they are necessary. As the frequency of defrost operations is increased, the energy consumption is increased, because the defrost heater is energized at every defrost operation. During the defrost operation, the temperature in the compartments of the refrigerator increases. As a result, food in the compartments can become spoiled.

SUMMARY OF THE INVENTION

It is an object of the invention to provide an improved defrosting control for a refrigerator.

It is another object of the invention to improve the timing of defrosting in a refrigerator.

It is further object of the invention to reduce the frequency of a defrosting operation by controlling defrost timing in accordance with the defrost load of a refrigerator.

To achieve the above objects, the defrost control apparatus and method of the present invention detects the total number of times a door of the refrigerator is opened and the outside temperature. The time at which a defrosting cycle starts is estimated with fuzzy logic reasoning which uses the total number of times the door is opened and the outside temperature value as input variables.

The invention may also detect the total compressor operating time, and the refrigerator operating time after the total compressor operating time reaches a predetermined time. The time that defrosting is started after the previous defrosting cycle is postponed from a time after the total compressor operating time reaches at a predetermined time until the refrigerator operating time reaches the time period determined by the fuzzy logic reasoning.

BRIEF DESCRIPTION OF THE DRAWINGS

These and other objects and advantages of this invention will become more apparent and readily appreciated from the following detailed description of the presently preferred exemplary embodiments, taken in conjunction with the accompanying drawings, of which:

FIG. 2 is a block diagram of the defrost control apparatus;

FIG. 6 shows a fuzzy logic production rule, wherein a value corresponding to an average outside temperature is used as an input variable A, and a value corresponding to total door open value related to a number of openings of a door of a refrigerator is used as an input variable B, and a postponing defrost time, which is the result of the fuzzy logic reasoning, is shown as variable C.

DETAILED DESCRIPTION OF PRESENTLY PREFERRED EXEMPLARY EMBODIMENTS

An embodiment of the present invention will be explained with reference to the accompanying drawings.

Figure 1:
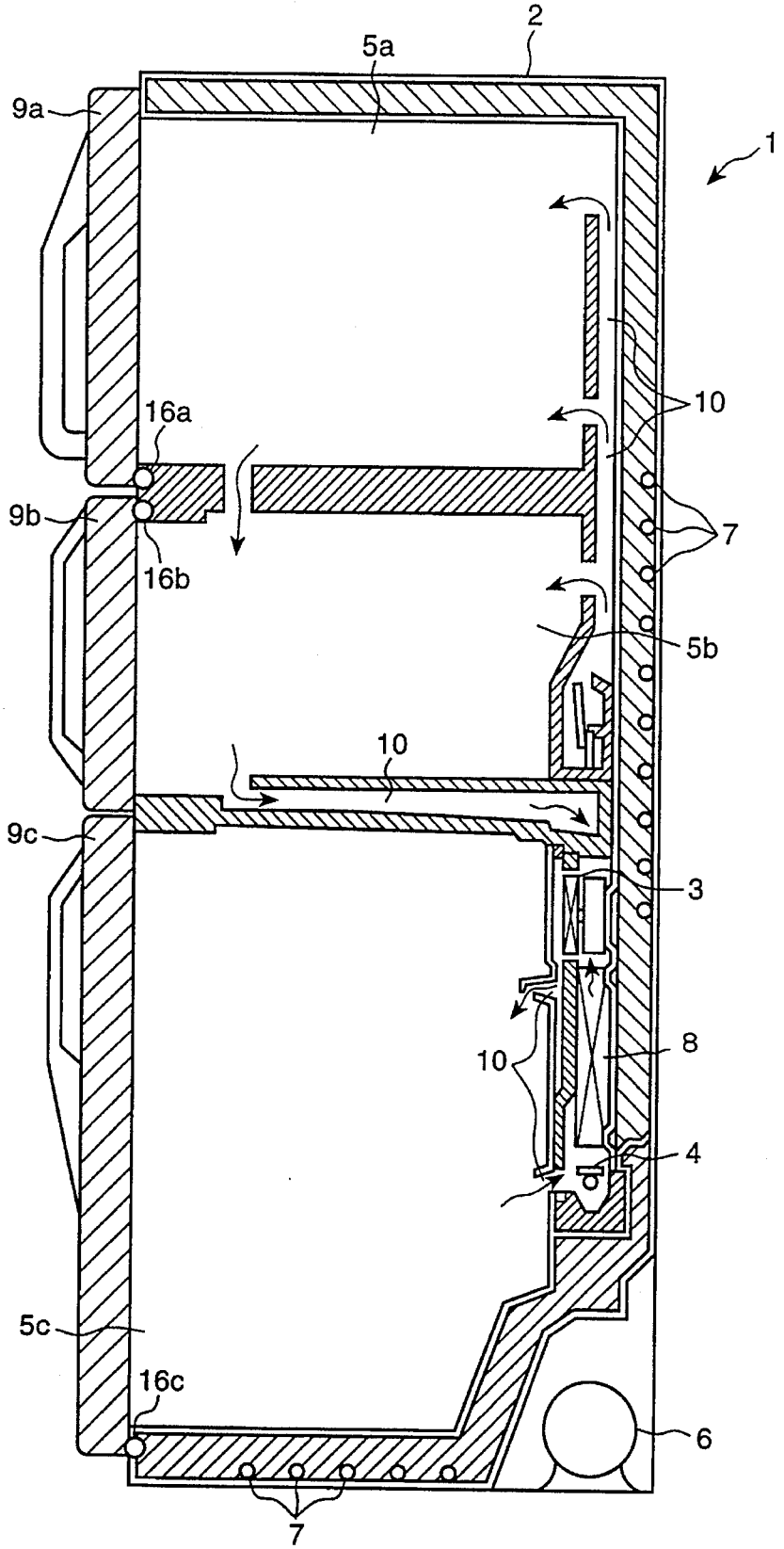
FIG. 1 is a cross-sectional view of a refrigerator controlled by a defrost control apparatus according to the present invention.

In FIG. 1, refrigerator 1 includes a casing 2, a closed refrigerant circuit, a fan 3, a defrost heater 4 and three compartments 5*a* to 5*c*. The closed refrigerant circuit includes a compressor 6 to compress the refrigerant in the closed circuit, a radiation coil 7, an expansion device (not shown in FIG. 1), and a cooling coil 8. Radiation coil 7 is attached to an outer surface of casing 2. Heat from radiation coil 7 is transferred to the outside of refrigerator 1. Compartment 5*a* is for storing frozen food. Compartment 5*b* is a refrigerating compartment. Compartment 5*c* is a vegetable compartment. Each compartment has a door 9*a* to 9*c* which is rotatably supported by casing 2 to be able to open and close. Also, each compartment has a door switch 16*a* to 16*c*, for example a micro switch, to detect whether each door is open or not. Air blown by fan 3 passes through air ducts 10, and circulates in the refrigerator as shown by arrows in FIG. 1. Defrost heater 4 is located in air duct 10 and under cooling coil 8. The heat generated by defrost heater 4 is efficiently transferred to cooling coil 8, so that ice accumulated on cooling coil 8 is melted by defrost heater 4.

Referring now to FIG. 2, a defrost control apparatus will be explained.

Refrigerator controller 11 controls the operations of a fan 3 and a compressor 6 in accordance with the inner temperature Tmi of refrigerator 1, detected by an inner temperature sensor 13, for example a thermistor. Refrigerator controller 11 outputs a first signal related to an operation of compressor 6, a second signal related to power supplied to refrigerator 1 and a reset signal. The first signal is supplied to a compressor operation timer 20 and a continuous compressor operation timer 26. Compressor operation timer 20 accumulates the total time Ttc during which compressor 6 is operating since the last defrost cycle and outputs total compressor operating time Ttc to a refrigerator operation timer 27. That is, compressor operation timer 20 counts time only when compressor 6 is energized by refrigerator controller 11 and accumulates the time as total compressor operating time Ttc.

Continuous compressor operation timer 26 counts each time period while compressor 6 is energized and stores each time period. The time period data stored by continuous compressor operation timer 26 are used to determine an initial continuous compressor operating time period Tcc and a continuous compressor operating time period Tci. After a defrost operation, when compressor 6 is energized, continuous compressor operation timer 26 is started, and when compressor 6 is initially turned off, the time count is stopped. At this time, the time period counted by continuous compressor operation timer 26 is stored as the initial continuous compressor operating time period Tci. Continuous compressor operation timer 26 transfers the initial continuous compressor operating time period Tci to a third defrost controller 30. Other counted times, which are counted after compressor 6 initially turns off after a defrost cycle, are stored as continuous compressor operating times Tcc. Continuous compressor operation timer 26 further selects a maximum continuous compressor operating time period Tcm among the Tci data stored therein, and transfers Tcm to third defrost controller 30. Stored time data Tcm and Tci are cleared by the reset signal from refrigerator controller 11.

The second signal of refrigerator controller 11 is supplied to a refrigerator operation timer 27 which counts the refrigerator operating time Ttr after total compressor operating time Ttc accumulated by compressor operation timer 20 reaches 10 hours.

An outside temperature detecting means 15 has an outside temperature sensor 12 which detects an outside temperature Tmo outside of refrigerator 1 at 1 hour intervals and outputs an outside temperature Tmo to an outside temperature memory 14. Outside temperature memory 14 receives a temperature signal from outside temperature sensor 12 and stores the temperature Tmo and calculates an average outside temperature which is used as outside temperature value Tma for fuzzy logic reasoning. That is, in this embodiment, the outside temperature value is an average outside temperature detected at 1 hour intervals.

The detection signal of door switches 16*a* to 16*c* is transferred to a door open counter 18 and a door open timer 24. Door open counter 18 accumulates a total door open value Cdv related to the number of times doors 5*a* to 5*c* are opened. Door open timer 24 accumulates the total door open time value Tdv related to the total time period that any of the three doors is opened. That is, if each door switch 16*a* to 16*c* detects that the corresponding door has been open for a total of 10 minutes, total door open time value Tdv accumulated by door open timer 24 is 0.5 hours.

However, total door open time value Tdv can relate to other data associated with the total door open time period. For example, total door open time value Tdv can be calculated by accumulating the time that each door is open, multiplied by a predetermined constant for each door. In this calculation, predetermined constants for each door are determined in relation to the volume of air exchanged between each compartment and the outside when each door is opened. More specifically, each constant is determined in accordance with the volume of the compartment which is covered by each door, the area of each door and/or a kind of compartment which the door covers. For example, freezer compartment 5*a* is almost the same volume of a vegetable compartment 5*b*. The volume of refrigerator compartment 5*c* is twice that of freezer compartment 5*a* or the vegetable compartment 5*b*. The constant for the freezer compartment door 9*a* is the same as it of vegetable compartment door 9*b*, and the constant of refrigerator compartment door 9*c* is double that. In this example, 0.5 is the constant for the freezer compartment door and the vegetable compartment door, and 1 is the constant for the refrigerator compartment door. Accordingly, if each of door switches 16*a* to 16*c* detects that each door is open 10 minutes, door open time value Tdv is 5+5+10=20 minutes.

Postpone defrost time estimator 22 includes fuzzy logic which uses total door open value Cdv and outside temperature value Tma as input variables. The fuzzy logic estimates a postpone defrost time Tpt in accordance with the input variables. The postpone defrost time Tpt is estimated when the total compressor operating time period Ttc, which is input from compressor operating timer 20, reaches 8 hours and at 1 hour intervals after Ttc reaches 8 hours. Both fuzzy membership functions and fuzzy logic production rules, which are used in postpone defrost time estimator 22, are stored in a memory included in postpone defrost time estimator 22. The details of the fuzzy membership functions and fuzzy logic production rule are described later. The output of postpone defrost time estimator 22, postpone defrost time Tpt, is supplied to first defrost controller 28. First defrost timer 28 receives refrigerator operating time Ttr and postpone defrost time Tpt, and compares them. When Ttr is more than Tpt, first defrost controller 28 outputs a defrost signal to refrigerator controller 11.

Under certain conditions, defrosting is performed, despite the operation of first defrost controller 28, by second defrost controller 29, third defrost controller 30 or initial defrost controller 31. Second defrost controller 29 outputs a defrost signal when total door open time value Tdv reaches 0.5 hours after total compressor operate time Ttc reaches 8 hours. The reason for including second defrost controller 29 is that vapor included in the air within refrigerator increases when the total door open time period is increased. Third defrost controller 30 outputs a defrost signal after the total compressor operating time Ttc reaches 8 hours and the initial continuous compressor operating time period Tcc is 5 hours or more or the maximum continuous compressor operating time period Tcm is 3 hours or more. The reason for including third defrost controller 30 is that the accumulation of ice on cooling coil 8 is increased while compressor 6 is continuously energized. The defrost signals output from second and third defrost controllers 29, 30 are input to refrigerator controller 11, as is the defrost signal output from first defrost controller 28.

Initial defrost controller 31 receives both a power-on signal, which indicates that electrical power has been applied to the refrigerator, and total compressor operating time Ttc. Initial defrost controller 31 starts a defrost cycle only once when total compressor operating time period Ttc reaches 5 hours after electrical power is supplied to the refrigerator. When the electrical power initially starts to be supplied to the refrigerator, the air in the refrigerator includes much water or vapor. Therefore, the first defrost after the refrigerator is energized should be carried out at short time interval. Accordingly, initial defrost controller 31 starts a defrost cycle before first defrost controller 28 outputs its defrost signal.

When at least one of these defrost signals is input to refrigerator controller 11, refrigerator controller 11 starts the defrost operation. In the defrost operation, defrost heater 4 is energized, and compressor 6 and fan 3 are deenergized during a predetermined time, about 5 minutes. However, alternatives can be employed. For example, in a hot gas bypass defrost method, hot gaseous refrigerant, discharged from compressor 6, passes through tubes in cooling coil 8. Ice accumulated on cooling coil 8 is melted down by the energizing of defrosting heater 4. When defrosting is finished, defrost heater 4 is turned off, and refrigerator controller 11 outputs a reset signal to outside temperature memory 14, door open counter 18, door open timer 24, compressor operation timer 20 and continuous compressor operation timer 26. The reset causes the data stored and accumulated to be cleared. Also, refrigerator controller 11 outputs the reset signal when electrical power is first applied to the refrigerator.

Figure 3:
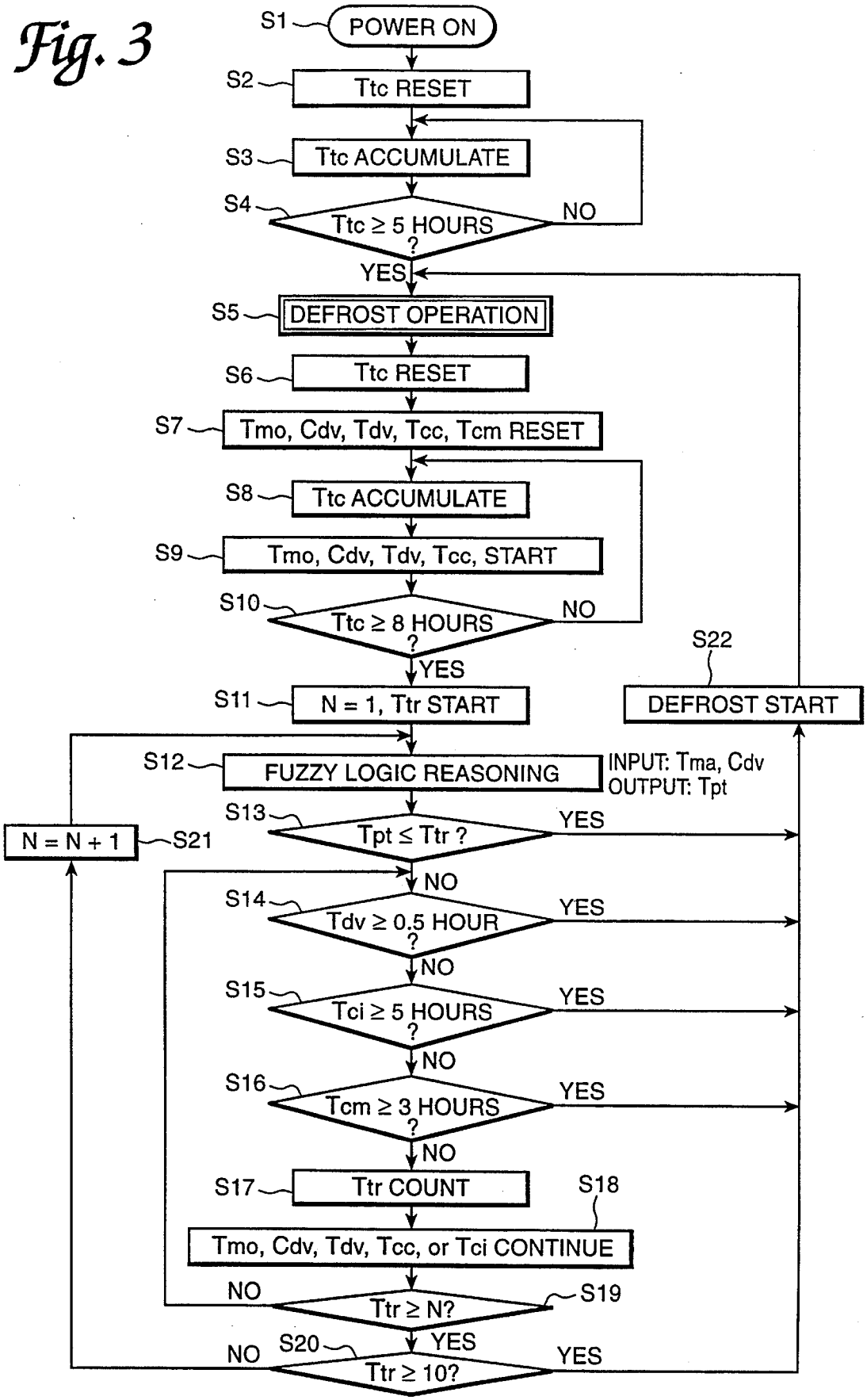
FIG. 3 is a flow-chart of the defrost control apparatus.
Figure 4:
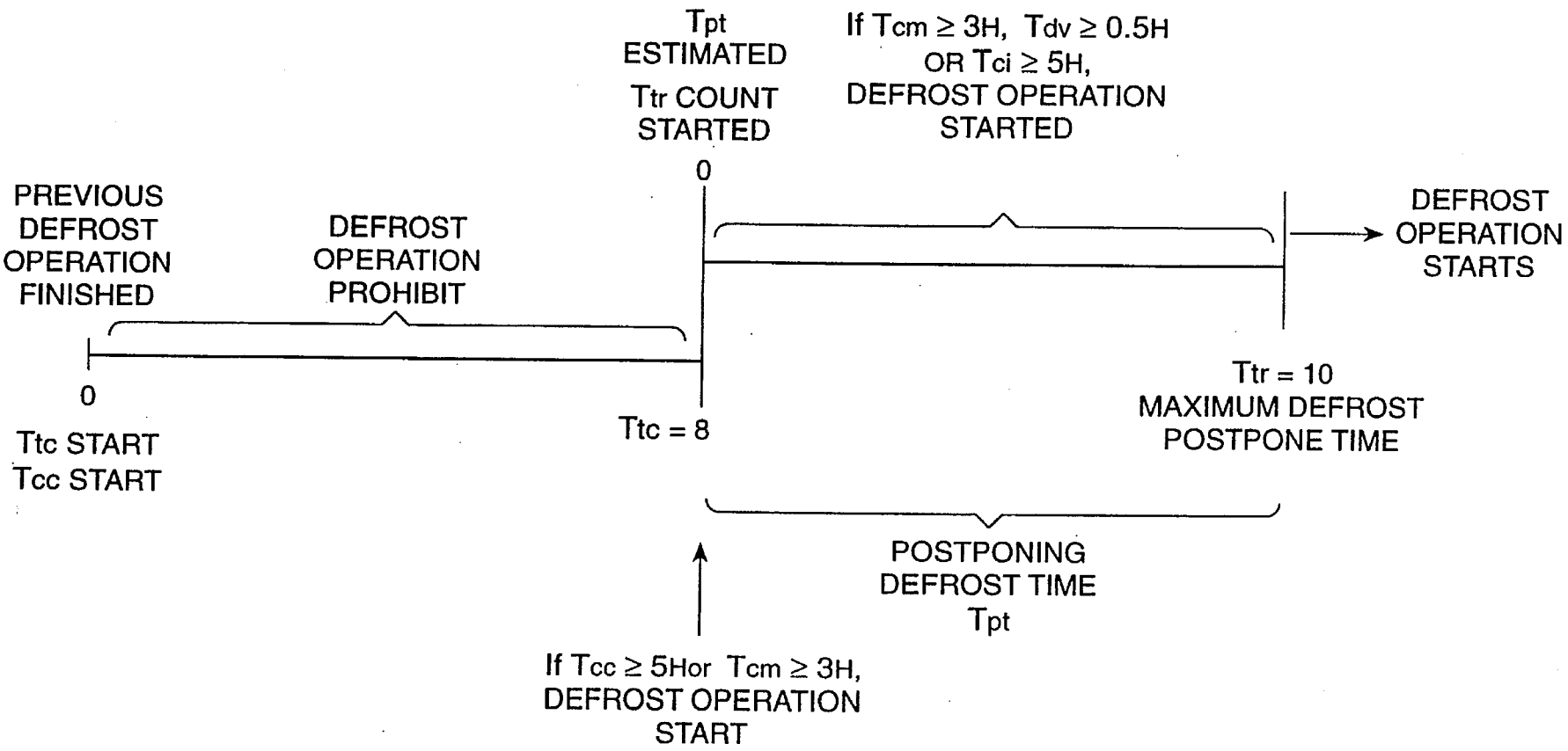
FIG. 4 is a timing diagram of defrost operation controlled by the defrost control apparatus.

Referring now to FIGS. 3 and 4, the operation of the refrigerator will be explained.

When electrical power is first applied to refrigerator 1, an operation flow starts at first step S1. In step S2, compressor operation timer 20 is reset, and total compressor operating time Ttc becomes 0. Then, compressor operation timer 20 starts to accumulate total compressor operating Ttc (step S3). In next step S4, Ttc is compared with 5 hours. If Ttc is no less than 5 hours, initial defrost controller 31 outputs a defrost signal to refrigerator controller 11. Refrigerator controller 11 starts a defrost operation by energizing defrost heater 4. The defrost operation is finished in about 5 minutes after defrost heater 4 is energized.

If Ttc is not more than 5 hours in step S4, the operation flow returns to step S3. Accordingly, the operation flow circulates from step S3 to step S4 until Ttc reaches at 5 hours.

After the initial defrost, compressor operation timer 20 is reset again (step S6), and outside temperature data Tmo stored in outside temperature memory 14, total door open value Cdv counted by door open counter 18, total door open time value Tdv accumulated by door open timer 24, and initial continuous compressor operating time period Tci and continuous compressor operating time period Tcc from continuous compressor operation timer 26 are reset (step S7). Then, compressor operation timer 20 starts to accumulate total compressor operating time Ttc (step S8), and outside temperature memory 14 starts to store outside temperature data Tmo at 1 hour intervals. At the same time, door open counter 18 starts to count total door open value Cdv, door open timer 24 starts to accumulate total door open time value Tdv, and continuous compressor operation timer 26 starts to count initial continuous compressor operating time period Tcc (step S9).

In the step S10, total compressor operating time Ttc is compared with 8 hours. If Ttc is less than 8 hours, the operation flow returns to step S8. Accordingly, the operation flow circulates from step S8 to step S10 until Ttc reaches 8 hours. That is, after the initial defrost, the next defrost operation is not carried out until total compressor operating time Ttc reaches 8 hours. If Ttc is no less than 8 hours, postpone defrost time operation starts. Hour counter N is set at 1 and refrigerator operation timer 27 starts to count refrigerator operating time Ttr (step S11). Hour counter N is used as an interval timer for the fuzzy logic. Namely, the estimation of postpone defrost time Tpt is carried out at 1 hour intervals. In step S12, postpone defrost time Tpt is estimated by fuzzy logic reasoning. The input variables of fuzzy logic reasoning, fuzzy variables, are outside temperature value Tma and total door open value Cdv. The details of operation of the fuzzy logic reasoning are described later.

The output of fuzzy logic reasoning, postpone defrost time Tpt is compared with refrigerator operating time Ttr by first defrost controller 28 (step S13). If Ttr is greater than or equal to Tpt, postpone defrost time operation is finished, and defrosting starts (step S22 and S5). If Ttr is less than Tpt, total door open time value Tdv is compared with 0.5 hours by second defrost controller 29 (step S14). In this embodiment, door open time value Tdv is the actual time which accumulates when each door is opened.

If total door open time value Tdv is greater than or equal to 0.5 hour in step S14, postpone defrost time operation is finished, defrosting starts (step S22 and step S5). If total door open time value Tdv is less than 0.5 hours in step S14, postpone defrost time operation is continued. In following step 15, initial continuous compressor operating time period Tci is compared with 5 hours (step S15). If Tcc is greater than or equal to 5 hours, postpone defrost time operation is finished, and defrost operation starts (steps S22 and S5). That is, if initial compressor operation time period after defrost is 5 hours or more, when total compressor operating period Ttc reaches 8 hours, defrosting starts (steps S22 and S5) even though postpone defrosting time Tpt may be less than operating time Ttr.

If initial continuous compressor operating time period Tcc is less than 5 hours, maximum continuous compressor operating time period Tcm is compared with 3 hours (step S16). If Tcm is greater than or equal to 3 hours, postpone defrost time operation is finished, and defrosting starts (steps S22 and S5). If Tcm is less than 3 hours, refrigerator operating time period Ttr is counted by refrigerator operating timer 27 (step S17). In step S18, outside temperature memory 14 continues to store outside temperature data Tmo, door open counter 18 continues to count total door open value Cdv, door open timer 24 continues to accumulate total door open time value Tdv, and continuous compressor operation timer 26 continues to count continuous compressor operating time period Tcc.

Then, refrigerator operating time Ttr is compared with hour counter N (step S19). If Ttr is less than N hours, the operation flow goes to step S14. The operation from step S14 to step S18 is repeated. If Ttr is greater than or equal to N hours, Ttr is compared with 10 hours (step S20). If Ttr is greater than or equal to 10 hours, the operation goes to step S22, postpone defrost operation is time over, and defrosting starts (step S5). That is, 10 hours in step S20 is the upper time limit in order to start a defrosting cycle, even when any of door switches 16*a* to 16*c*, outside temperature sensor 12, etc. malfunction.

If Ttr has not reached 10 hours, hour counter N is incremented by 1 (step S21), and the operation flow returns to step S12. In step S12, estimation of postpone defrost time Tpt is carry out again in accordance with fuzzy logic reasoning using variables Tma and Cdv which includes new data detected and accumulated in step S18. Accordingly, postpone defrost time Tpt is estimated at 1 hour intervals.

Referring now to FIG. 4, after a defrost operation, the next defrost operation is not carry out until total compressor operating time Ttc reaches 8 hours. When total compressor operating time Ttc reaches 8 hours, postpone defrost time Tpt is estimated and refrigerator operating time Ttr starts accumulating. Then Tpt and Ttr are compared to each other. When Ttr is greater than or equal to Tpt, the defrost operation starts. When initial continuous compressor operating time period Tci is greater than or equal to 5 hours, after total compressor operating time Ttc reaches 8 hours, a defrost operation is carried out. Further, when maximum continuous compressor operating time period Tcm is greater than or equal to 3 hours after Ttc reaches 8 hours, a defrost operation is also carried out. Furthermore, even when total door open time value Tdv becomes greater than or equal to 0.5 hours during postpone defrost time Tpt (after total compressor operating time Ttc reaches 8 hours), defrosting is carried out. Finally, if a defrost operation does not start before refrigerator operating time Ttr reaches 10 hours (after total compressor operating time Ttc reaches 8 hours), a defrost operation starts despite the other time factors, Tci, Tcm, Tdv, or Tpt.

Consequently, the defrost operation is postponed within the limit of 10 hours in accordance with fuzzy logic reasoning which considers a condition of the refrigerator, or the amount of ice on the cooling coil surface.

Figure 5A:
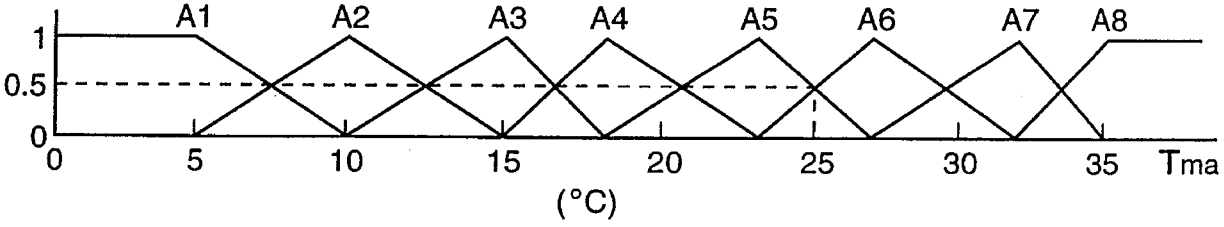
FIGS. 5(*a*) to 5(*c*) show membership functions of fuzzy logic reasoning.
Figure 5B:
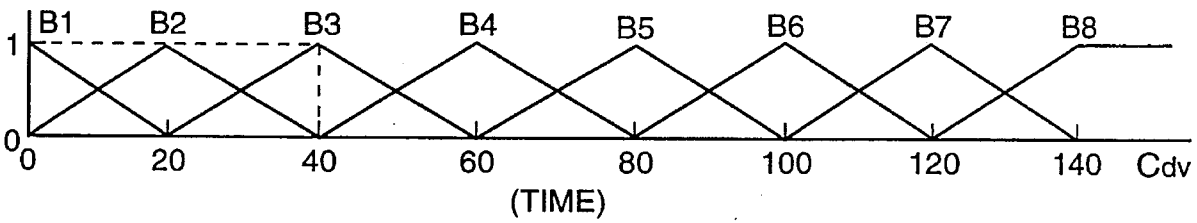
Figure 5C:
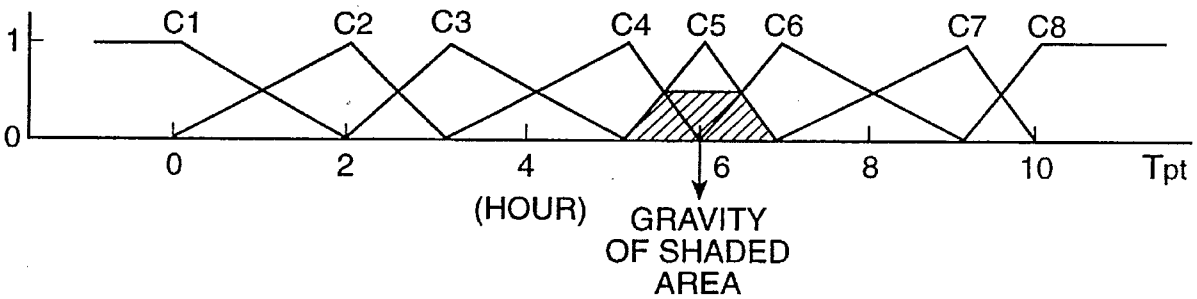

Referring now to FIGS. 5(*a*) to 7, the fuzzy logic reasoning executed by time estimator 22 will be explained.

The fuzzy logic reasoning has two input variables, outside temperature value Tma and total door open count value Cdvo Outside temperature value Tma is shown in FIG. 5(*a*), while total door open count value Cdv is shown in FIG. 5(*b*). The result of fuzzy logic reasoning, postpone defrost time Tpt, is shown in FIG. 5(*c*). The fuzzy logic production rule is shown in FIG. 6. If outside temperature value Tma, or average outside temperature in this embodiment, is 25° C., outside temperature value Tma belongs to the membership function A5 and A6, and the membership values are A5v= A6v=0.5. If total door open value Cdv is 40 times, total door open value Cd belongs to the membership function B3, and the membership value is B3v=1. Membership functions A5 and B3 produce output membership function C5, as determined by the fuzzy logic production rule shown in FIG. 6. Membership functions A6 and B3 also produce output membership function C5.

The output membership functions are illustrated in FIG. 5(*c*). To determine postpone defrost time Tpt, the center of gravity of the areas under the values of the indicated output membership functions must be determined. The value for each output membership function is selected to be the smaller value of the corresponding input membership functions.

In the above example, the value of output membership function C5, determined from A5v=0.5 and B3v=1, is the lower of the two values, i.e., 0.5. The area of C5 under this value is hatched in FIG. 5(*c*). Similarly, the value of output membership function C5, determined from A6v=0.5 and B3v=1, is also 0.5 and under this value is the same hatched area in FIG. 5(*c*). The center of gravity of the hatched area is Tpt=6 hours. Thus, postpone defrost time Tpt=6 is determined. Postpone defrost time Tpt obtained in this way in accordance with fuzzy logic reasoning is output from time estimator 22 to first defrost controller 28.

Figure 7:
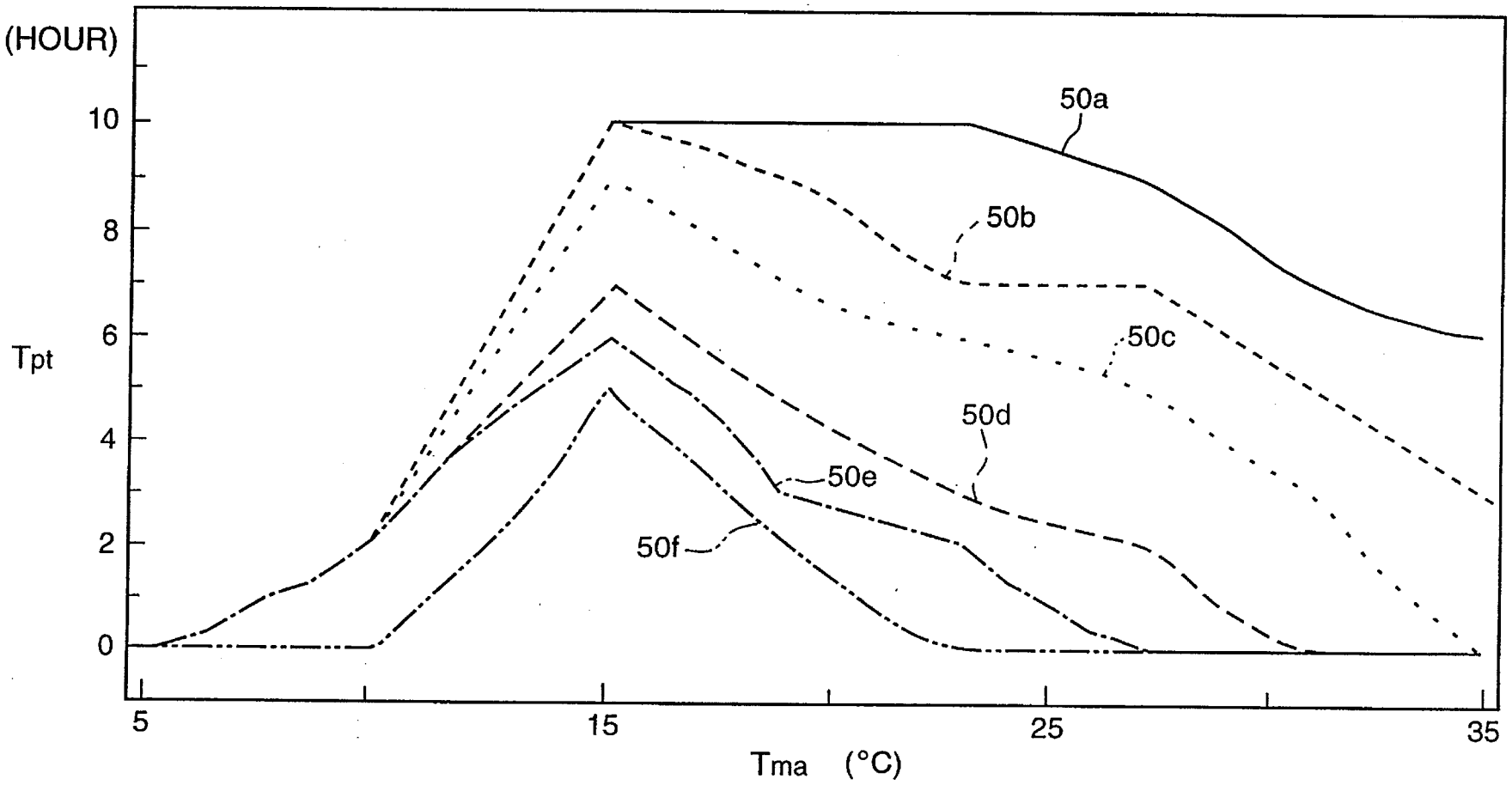
FIGS. 7 is a graph which shows a relationship between an outside temperature of the refrigerator and postponing defrost times decided by the fuzzy logic production rule in FIG. 6 and membership functions shown in FIGS. 5(*a*) to 5(*c*).

The typical postpone defrost time Tpt estimated in accordance with above described fuzzy logic reasoning is shown in FIG. 7. In FIG. 7, line 50*a* shows the change of postpone defrost time Tpt at door open value Cdv=0 times. Lines 50*b*, 50*c*, 50*d*, 50*e* and 50*f* show Tpt at Cdv=20, 40, 60, 80, and 100, respectively. Above outside temperature value Tma= 15° C., postpone defrost time Tpt is inversely related to door open value Cdv and outside temperature value Tma. Under outside temperature value Tma=15° C., postpone defrost time Tpt is directly related to door open value Cdv and outside temperature value Tma. Under Tma=15° C., ice does not accumulate so much on the cooling coil. However, the temperature of air which is heat transferred with the cooling coil and circulated in the refrigerator, is greatly decreased. As a result of low temperature air passing through air duct 10 between cooling coil 8 and compartments 5*a* to 5*b* in FIG. 1, frost is generated at some narrow portion of the air duct 10. When ice is accumulated, air duct 10 becomes blocked. Accordingly, under Tma=15° C., the fuzzy logic production rule causes the postpone defrost time Tpt to be directly related to door open value Cdv and outside temperature value Tma.

However, if the air duct does not collect ice, which can be controlled by the design of the air duct, such a fuzzy logic production rule is not necessary. Therefore postpone defrost time Tpt can be inversely related to door open value Cdv and outside temperature value Tma for all outside temperatures.

In the above embodiment, door open value Cdv is the actual number of the times that each door is opened. However, as with the total door open time value Tdv, door open value Cdv can relate to other data associated with the number of times doors 5*a* to 5*c* are opened. Namely, door open value Cdv can be calculated by accumulating the number of times each door is opened, multiplied by a predetermined constant for each door. The predetermined constant for each door is determined in relation to the volume of the exchanged air between each compartment and the outside when each door is opened, as with the constants used in calculation of total door open time value Tdv.

Many changes and modifications of the above described embodiment can be carried out without departing from the scope of the general inventive concept as defined by the appended claims and their equivalents.

What is claimed is:

1. A defrost control apparatus for a refrigerator which has a casing, a door supported by the casing to open or close a compartment of the refrigerator and a closed refrigerant circuit, which includes a cooling coil to cool air in the refrigerator and a compressor to compress the refrigerant, comprising:

door open count means for accumulating a total door open value related to a number of times of the door is opened, outside temperature detecting means for detecting a temperature outside of the casing;

defrost time estimate means for estimating a defrost time to begin the defrosting of the cooling coil after a previous defrost cycle in accordance with fuzzy logic reasoning which uses the total door open value and an outside temperature value related to the outside temperature as input variables; and defrost means for starting to defrost the cooling coil when the defrost time is reached.

2. A defrost control apparatus according to claim 1, further including:

compressor operating timer means for accumulating a total compressor operating time during which the compressor is operated; and wherein the defrost time estimate means estimates the defrost time after the total compressor operating time reaches a predetermined time.

3. A defrost control apparatus according to claim 2 further including:

refrigerator operating timer means for counting a refrigerator operating time after the total compressor operating time reaches the predetermined time; wherein the defrost means starts to defrost the cooling coil when the refrigerator operating time exceeds the defrost time.

4. A defrost control apparatus according to claim 1, 2 or 3, wherein the defrost time estimate means estimates the defrost time at predetermined time intervals.

5. A defrost control apparatus according to claim 1, 2 or 3, further including:

door open timer means for accumulating a total door open time value related to a total time period that the door is opened; and second defrost means for starting defrosting independent of the defrost time when the total door open time value reaches at a predetermined value.

6. A defrost control apparatus according to claim 1, 2 or 3, further including:

continuous compressor operating timer means for counting a continuous compressor operating time period during which the compressor is continuously operated; and third defrost means for starting defrosting independent of the defrost time when the continuous compressor operating time period reaches a predetermined time.

7. A defrost control apparatus according to claim 1, 2 or 3, wherein:

the refrigerator includes a plurality of doors; and the door open count means further includes door open calculating means for calculating a door open value of each door that is a number of times each door is opened multiplied by a predetermined constant for each door, and the door open count means for accumulating the door open values for each of the doors as the total door open value.

8. A defrost control apparatus according to claim 7, wherein the predetermined constant for each door is determined in accordance with a volume of a compartment covered with the door.

9. A defrost control apparatus according to claim 5, wherein:

the refrigerator includes a plurality of doors; and the door open timer means further includes calculating time means for calculating a door open time value that each door is opened multiplied by a predetermined constant for each door, and the door open timer means for accumulating the door open time value of each door as the total door open value.

10. A defrost control apparatus according to claim 9, wherein the predetermined constant for each door is determined in accordance with a volume of a compartment covered with the door.

11. A defrost control apparatus according to claim 1, 2 or 3, wherein the defrost time estimate means causes the defrost time to increase as the outside temperature increases over a range of outside temperatures.

12. A defrost control apparatus according to claim 1, 2 or 3, wherein:

the outside temperature detecting means detects the outside temperature at predetermined intervals; and the defrost time estimate means further includes temperature converting means for averaging the outside temperature over a plurality of the predetermined intervals as the outside temperature value.

13. A defrost control apparatus according to claim 3, further including fourth defrost means for starting defrosting independent of the defrost time when the refrigerator operating time reaches a predetermined maximum time.

14. A defrost control apparatus according to claim 1, further including reset means for resetting the total door open value accumulated by the door open count means when the cooling coil is defrosted.

15. A defrost control apparatus according to claim 2, further including reset means for resetting the total door open value accumulated by the door open count means and the total compressor operating time accumulated by the compressor operating timer means when the cooling coil is defrosted.

16. A method for controlling defrosting of a refrigerator having a door and a closed refrigerant circuit which includes a cooling coil and a compressor, the method comprising the steps of:

accumulating a total door open value related to a number of times the door is opened;

detecting a temperature outside of the refrigerator;

estimating a defrost time to begin the defrosting of the cooling coil after a previous defrost cycle in accordance with fuzzy logic reasoning which uses the total door open value and an outside temperature value related to the outside temperature as input variables; and starting to defrost the cooling coil when the defrost time is reached.

17. A method for controlling defrosting of a refrigerator having a plurality of doors and a closed refrigerant circuit which includes a cooling coil and a compressor, the method comprising the steps of:

detecting a number of the times each door is opened;

calculating a door open value of each door that is the number of times each door is opened multiplied by a predetermined constant for each door;

accumulating the door open values of each door as a total door open value;

detecting a temperature outside of the refrigerator;

estimating a defrost time to begin the defrosting of the cooling coil after a previous defrost cycle in accordance with fuzzy logic reasoning which uses the total door open value and an outside temperature value related to the outside temperature as input variables; and starting to defrost the cooling coil when the defrost time is reached.

18. A method for controlling defrosting according to claim 17, wherein the predetermined constant for each door is determined in accordance with a volume of a compartment covered with the door.

19. A method for controlling defrosting according to claim 16 or 17 further comprising the step of:

accumulating a total compressor operating time during which the compressor is operated; wherein the estimating step estimates the defrost time after the total compressor operating time reaches at a predetermined time.

20. A method for controlling defrosting according to claim 19 further comprising, the step of:

counting a refrigerator operating time after the total compressor operating time reaches the predetermined time; wherein the starting step starts defrosting when the refrigerator operating time exceeds the defrost time.

21. A method for controlling defrosting according to claim 16 or 17, wherein the estimating step is carried out at predetermined time intervals.

22. A method for controlling defrosting according to claim 16 or 17, further comprising the steps of:

accumulating a total door open time value related to a total time period that the door is opened; and starting defrosting independent of the postpone defrost time when the total door open time value reaches at a predetermined value.

23. A method for controlling defrosting according to claim 16 or 17, further comprising the steps of:

counting a continuous compressor operating time period during which the compressor is continuously operated; and starting defrosting independent of the defrost time when the continuous compressor operating time period reaches a predetermined time.

24. A method for controlling defrosting according to claim 16 or 17, wherein:

the step of detecting the outside temperature detects the outside temperature at predetermined intervals; and the outside temperature value corresponds to an average of the outside temperature over the predetermined intervals.

25. A method for controlling defrosting according to claim 20, further comprising the step of:

starting defrosting independent of the defrost time when the refrigerator operating time reaches a predetermined maximum time.

26. A method for controlling defrosting according to claim 16 or 17, further comprising the step of:

resetting the total door open value accumulated by the door open count means when the cooling coil is defrosted.

27. A method for controlling defrosting according claim 19, further comprising the step of:

resetting the total door open value and the total compressor operating time period when the cooling coil is defrosted.

* * * * *